United States Patent [19]

Irwin

[11] 4,364,140

[45] Dec. 21, 1982

[54] PIPE CLEANOUT TOOL

[76] Inventor: Lawrence F. Irwin, 12860 San Fernando Rd., Sylmar, Calif. 91342

[21] Appl. No.: 262,958

[22] Filed: May 12, 1981

[51] Int. Cl.[3] ..... B08B 9/02

[52] U.S. Cl. ..... 15/104.3 SN

[58] Field of Search ..... 15/104.3 R, 104.3 SN; 15/104.16; 254/134.7

[56] References Cited

U.S. PATENT DOCUMENTS 1,851,766 3/1932 Hotchkiss, Jr. ..... 15/104.3 SN 3,121,244 2/1964 Hunt ..... 15/104.3 SN

FOREIGN PATENT DOCUMENTS 1784116 3/1972 Fed. Rep. of Germany ..... 15/104.3 SN

*Primary Examiner*—Edward L. Roberts

*Attorney, Agent, or Firm*—James E. Brunton

[57] ABSTRACT

A compact auger-type cleanout tool for use in clearing stoppages in waste pipes associated with sinks, bathtubs, water closets and the like in which any required number of additional lengths of plumbers' snake can be added to the device without removing the snake from the line. The device includes one or more telescoping tubular housings and a drive member associated therewith adapted to transmit rotary movement to the plumbers' snake. The initial length of snake fed into the line includes a uniquely designed coupling leader to which additional lengths of snake can readily be coupled making the device suitable for cleanout of very long runs of waste pipe.

10 Claims, 10 Drawing Figures

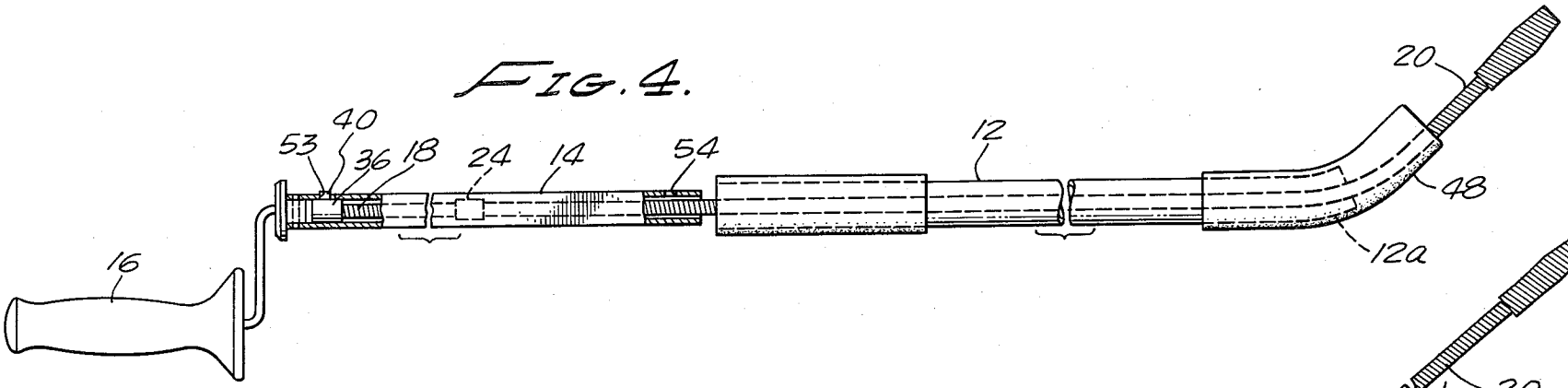
FIG. 4.
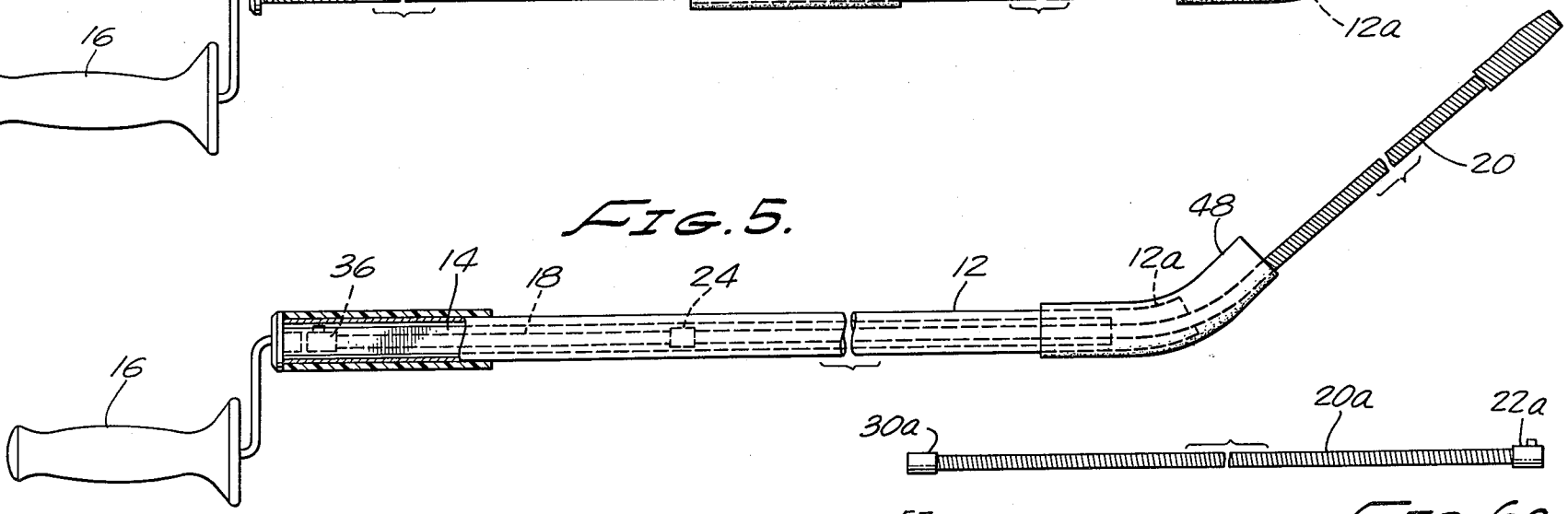
FIG. 5.
FIG. 6a.
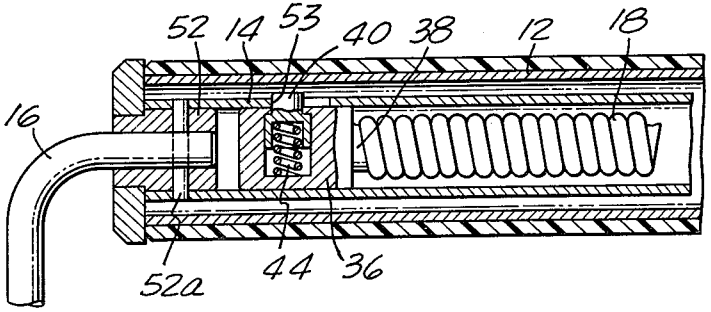
FIG. 6.

PIPE CLEANOUT TOOL

BACKGROUND OF THE INVENTION

1. Field of the Invention

This invention has to do with pipe cleanout tools such as are used for removing stoppages in waste pipes, particularly those leading from sinks and water closets.

2. Discussion of the Prior Art

Prior art closet augers of the type used principally for clearing stoppages in pipes leading from water closets and the like are for the most part cumbersome and often difficult to use. One reason for this is that to properly remove water closet stoppages it is necessary to rotatably insert at least about three feet of "snake" or coiled spring into the system. Accordingly the typical prior art closet auger consisted of a tubular barrel or casing about three feet in length, a flexible plumber's snake of about the same length and a handle also about three feet in length to which the end of the snake was affixed. In operating the device, the snake is withdrawn into the tube so that the handle extends upwardly about three feet from the end of the tube. The end of the snake is then inserted into the water closet and the handle is telescoped into the tube with a rotating action forcing the three foot length of snake downwardly into the water closet piping. Since at the beginning of the cleanout operation the handle is more than six feet above floor level, operation of the device is quite cumbersome.

In an attempt to make the closet auger easier to store, transport and use, Robert G. Hunt suggested a novel improved device which permitted the overall length of the tool to be reduced. This device is described in U.S. Pat. No. 3,121,244. While Hunt provided a more versatile and easier to use device, the maximum length of snake which could be inserted into the piping was still limited. This limitation made the tool useful for only certain types of applications and when, for example, a sink system or similar plumbing circuit was clogged, other types of cleanout devices having longer lengths of available snake were required to be used.

The present invention constitutes a marked improvement over the basic Hunt invention permitting the improved device to be used for a wide variety of cleanout operations. Due to the novel construction of the device of the present invention, there exists virtually no limitations on the length of snake which can be inserted into the plumbing circuit. This feature, plus other features involving the telescoping aspects of the device presently to be described make it useful in cleaning out clogged sinks, bathtubs and like plumbing circuits as well as water closet stoppages.

SUMMARY OF THE INVENTION

It is an object of the present invention to provide a novel improved auger type cleanout tool which is compact and easy to use for cleaning out sinks, bathtubs, toilets and other plumbing circuits and in which any required number of additional lengths of plumbers snake can readily be added thereby permitting cleanout of very long runs of waste pipe.

Another object of the invention is to provide an auger type cleanout tool which includes one or more cooperating, telescoping tubular housings and a drive tube telescopically associated therewith adapted to transmit rotary movement to a coupling leader to which multiple lengths of plumber's snake can be operably coupled.

Another object of the invention is to provide a cleanout tool as described in the preceeding paragraphs in which the drive tube is hollow and in which the initial length of plumber's snake which can be inserted into the waste system is substantially equal to the combined lengths of the tubular housings and the drive tube. However, because of the unique design of the tool approximately one third to one half of the length of the plumber's snake can be housed within the drive tube during transport and storage of the tool.

Still another object is to provide an easily operated device having positive means for locking the snake in the drive tube or inner housing in selected positions therein in an efficient quick manner without the need of any tools, keys, or the like.

A further object is to provide a telescoping handle construction having high torque strength.

Another object is to provide a telescoping handle which accommodates and operates efficiently with either a core reinforced wire or hollow type of flexible snake.

BRIEF DESCRIPTION OF THE DRAWINGS

FIG. 4 is a side elevational view partly in section similar to FIG. 3 but showing the coupling leader telescopically received within the drive member and connected thereto at the inboard end of the member.

FIG. 5 is a side elevational view partly in section showing the device in a normal transport or storage configuration with the drive member telescopically received within the outer casing of the tool.

FIG. 6 is a greatly enlarged fragmentary cross-sectional view showing the manner in which the crank handle is interconnected with the drive tube.

FIG. **6*a*** is a foreshortened view of a supplementary length of snake.

Figure 7:
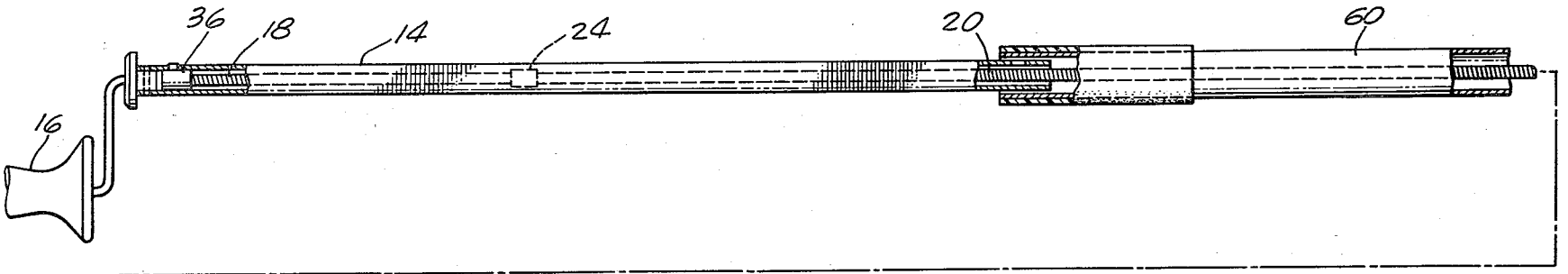
Figure 7:
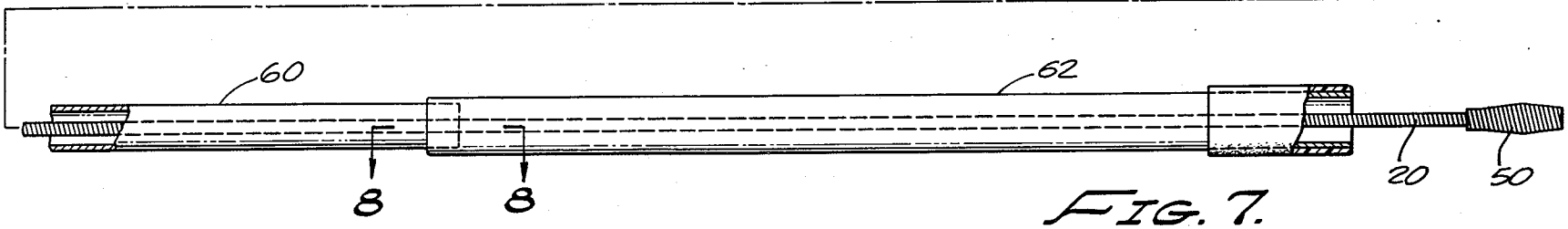

FIG. 7 is a side elevational view partly in section showing an alternate form of the device having first and second telescoping casings.

Figure 8:
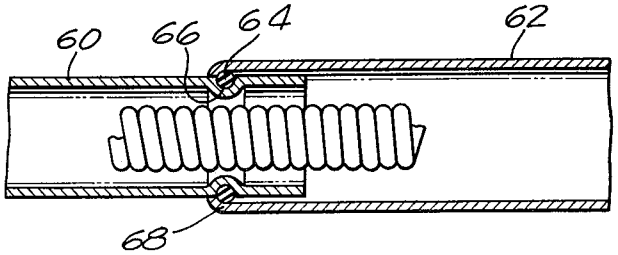

FIG. 8 is an enlarged cross-sectional view taken along lines 8—8 of FIG. 7.

Figure 9:
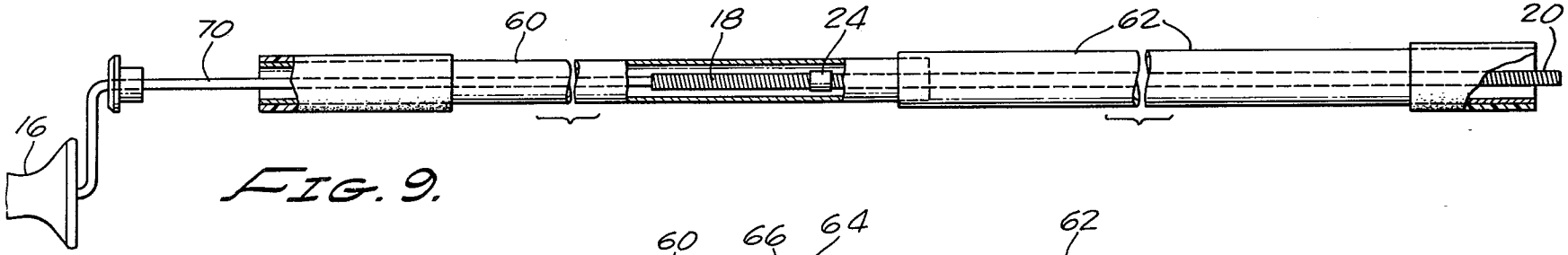

FIG. 9 is a side elevational view partly in section illustrating yet another form of the tool of the invention in which the drive member is a solid cylindrically shaped rod.

DESCRIPTION OF PREFERRED EMBODIMENTS OF THE INVENTION

Figure 1:
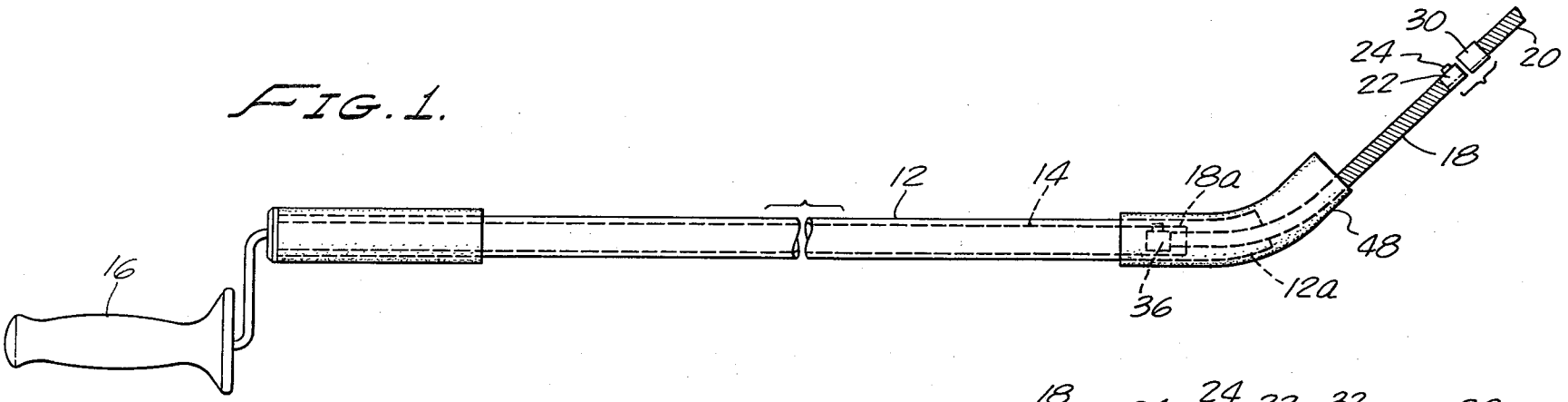
FIG. 1 is an exterior, side elevational view of the basic device in a telescoped configuration ready to be interconnected with a length of coiled spring or plumber's snake.

Referring to the drawings and particularly to FIGS. 1 through **6*a*, the basic form of the cleanout tool of the invention is there illustrated. The basic components of this form of the invention include a first elongated casing member 12, an elongated hollow drive member 14 telescopically receivable in casing member 12, an interengaging means shown here in the form of a crank handle 16 affixed to one end of drive member 14, and a coupling leader 18 connected to the other end of drive member 14**.

As indicated in FIG. 1, the coupling leader 18 is of such a length as to project a limited distance from the casing member 12 when the drive member is fully telescopically received within the casing member. As can best be seen by referring to FIG. 2, coupling member 18 has at its outboard, or free end, first interlocking means for removably interconnecting to the coupling a length of flexible coiled spring 20. In the embodiment of the invention shown in FIG. 2, the first interlocking means is provided in the form of a male member 22 having a detent mechanism including a pin 24 mounted in a bore 26 formed in the member 22. The pin 24 is normally urged outwarded by a spring 28 bearing against member 22 at its lower extremity and at its upper extremity bearing against a shoulder portion 24*a* formed on pin 24.

Coiled spring 20 is provided at one end thereof with a second interlocking means adapted to mate with the first interlocking means provided on the coupling leader. In the form of the invention shown in FIG. 2, this second interlocking means comprises a female member 30 which is counter bored to closely receive male member 22 provided at the end of the coupling leader. Female member 30 is provided with an aperture 32 adapted to closely receive pin 24 of the aforementioned detent mechanism carried by the coupling leader 18.

Figure 2:
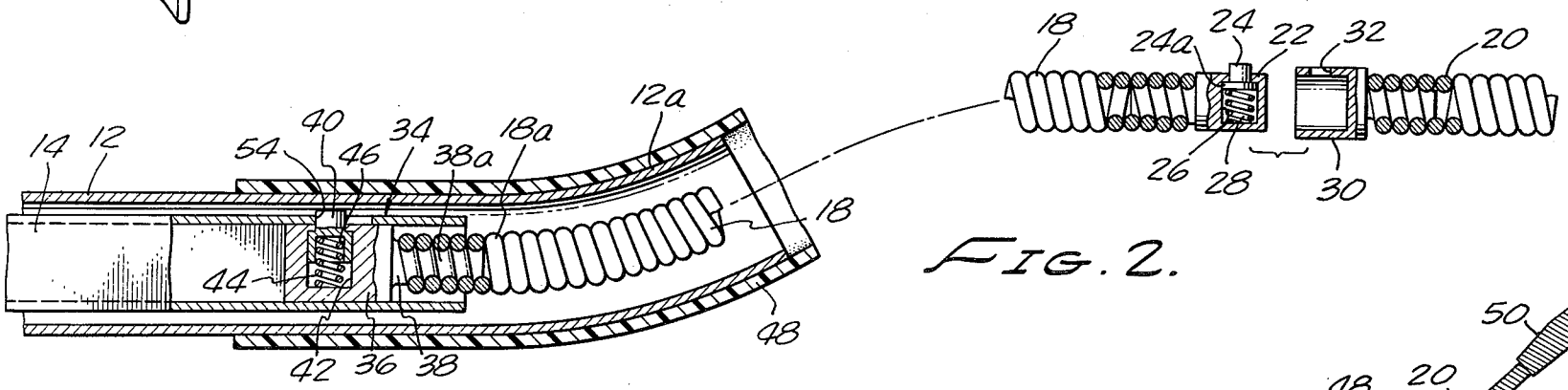
FIG. 2 is a greatly enlarged fragmentary cross-sectional view illustrating the construction of the means for interconnecting the coupling leader to the snake and to the drive member of the device.

Referring to FIGS. 1 and 2, the inboard end 18*a* of the coupling leader 18 is adapted to be interconnected to a drive block assembly 34 having a main body 36 which is shaped to fit closely but slidably within hollow drive member 14. Main body 36 (FIG. 2) is provided with a reduced shank, or stem portion 38 which includes a helical groove 38*a* adapted to threadably receive the inboard end of coupling leader 18. While the use of a helical groove to mate with the helical coils of spring 20 is a preferable form of securing the snake to the driving member 36, any suitable means may be used for making such a connection between the parts.

Member 36 is also provided with a detent mechanism consisting of a pin 40 mounted in a bore 42 provided in member 36. This detent pin 40 is counter bored to receive a spring 44 bearing against member 36 at its lower extremity and received at its upper extremity in the counter bore designated by the numeral 46. As will be described in greater detail hereinafter, detent pin 40 is adapted to be selectively received in any one of two or more apertures provided in drive member 14.

The tubular barrel or casing 12 of the device is preferably made of metal and may be provided with a curved end portion 12*a* to form a guide for causing the flexible coiled spring or snake 20 to move axially at an angle with respect to the casing. End portion 12*a* is also covered with a guard tube 48 which may be made of plastic or rubber so as to not mar or mark a toilet bowl, bathtub, sink or the like.

Figure 3:
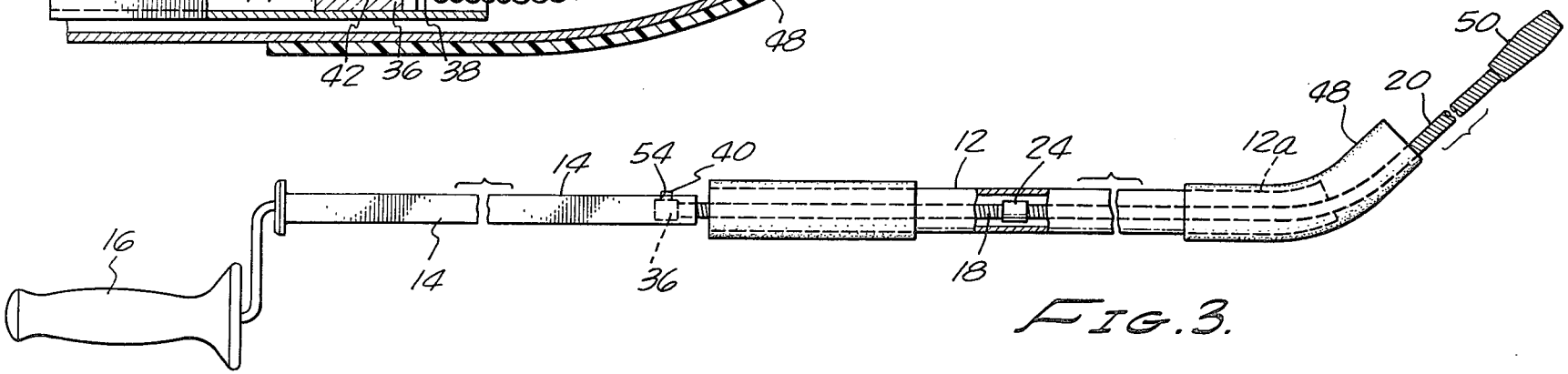
FIG. 3 is a side elevational view partly in cross-sectional showing the snake interconnected with the coupling leader and the drive member withdrawn from the outer casing.

As indicated in FIG. 3, the coiled spring or snake 20 is provided with a wire head 50 which may be of any conventional type adapted to engage and free blockages within the waste line. Coiled spring or snake 20 may be of various configurations commonly available from plumbing equipment outlets, In the form of the invention shown in the drawings, however, the coiled spring is shown in the form of a spring wire which has been coiled into a tight helical configuration.

Within the outer casing 12, which is preferably cylindrical, there is provided the previously identified drive tube 14 which is preferably, but not necessarily, non-circular in cross-section. The drive tube shown in the drawing is substantially square in cross-section being lightly rounded at its corners so as to freely telescope within the outer casing 12.

Referring now to FIG. 6, the inboard end of drive member 14 is provided with the crank handle 16, the inner end of which is fixed in a block 52 fitted in and welded, brased, or pinned to member 14. In the form of the invention shown in the drawings, a pin 52*a* is provided for the purpose. It is to be understood that the drive member may be rotated by any suitable mechanism including various types of electrical power drive units.

In operating the basic tool of the invention the parts are adjusted relative to one another into the configuration shown in FIG. 1 with the drive block 36 positioned at the outboard end of the drive member 14. In this configuration the end of the coupling leader 18 protrudes from the guide tube to permit the initial attachment thereto of a length of coiled spring, or snake, of an appropriate length. The length of snake to be used should be substantially equal to the combined length of the casing 12 and the drive member 14. The length of these members is governed by the use to be made of the tool. For example, if the tool is to be used solely for the cleanout of sinks, the parts may be relatively short, perhaps on the order of eighteen inches so that the tool can be conveniently manipulated at sink height. In this case the initial length of snake to be coupled with the leader would be on the order of thirty-six inches. On the other hand, if the tool is to be used primarily for cleanout of water closets, the casing and drive member may be longer, perhaps on the order of three feet. In this case the snake selected to be initially coupled with the leader would be about six feet in length.

Once the appropriate length of snake 20 is connected to the leader 18, the tool is moved into the configuration shown in FIG. 3 with the drive member 14 retracted from the casing 12. Next, the drive block assembly 36 is telescoped within drive member 14 and pin 40 is locked in a hole 53 formed at the inboard end thereof in the manner illustrated in FIG. 4. Finally the drive member 14 is once more telescoped into casing 12 placing the tool in the storage and transport configuration shown in FIG. 5.

With the tool having been transported to the job site in the configuration illustrated in FIG. 5 the cleanout operation can begin. As a first step, the drive member 14 is withdrawn from the casing 12 to retract the snake into the housing. The snake then can be advanced through the plumbing circuit by telescoping the members 12 and 14, the operator conveniently grasping the drive member with one hand and the casing with the other. As conditions require, the handle can be turned to rotate the snake and assist its progress through the pipe. When the snake has been advanced as far as permitted by this setting and to the approximate position of FIG. 5, the detent pin 40 may be pressed in and the drive member 14 withdrawn until the detent is positioned in the hole 54 formed in the outboard end of member 14. The configuration of the tool is now substantially that shown in FIG. 3. The drive member can now be rotated and again advanced or telescoped into the housing to fully extend the snake as shown in FIG. 1.

The drive tube is also effective to rotate the snake irrespective of whether the detent is received in one of the holes 53 or 54 and thus the tool can be used with the snake partially housed in the drive tube.

With the snake fully extended in the manner shown in FIG. 1, the detent assembly at the outboard end of the leader is easily accessible and pin 24 may be pressed in and the coupling leader 18 separated from the initial length of the snake 20. Once the coupling leader is separated it may be readily recoupled to a second interlocking means having a female member 30*a* (FIG. 6*a*) provided proximate the end of a supplementary length of snake 20*a*. The interlocking means is identical to that provided on the end of the initial length of snake 20 and the coupling of the members is accomplished in the manner previously described. Provided proximate the other end of supplementary snake 20*a*, which is approximately the same length as the initial snake 20, is a male fitting 22*a* configured identically to the male fitting of the first interlocking means carried by the coupling leader 18. By means of this interlocking means the supplementary length of snake can readily be connected to the initial section of snake now extending into the plumbing circuit.

Once the supplementary length of snake 22*a* is interconnected intermediate the coupling leader and the initial length of snake, the tool is manipulated in the manner previously described to adjust it from the configuration illustrated in FIG. 1 to that illustrated in FIG. 4. The tool is now ready to introduce the supplementary length of snake into the clogged line. This is accomplished in the identical manner as previously described for introduction into the line of the initial length of snake.

Due to the unique design of the device of the present invention the operational steps described in the preceeding paragraphs can be repeated to add as many supplemental lengths of snake as may be required to reach and clear the blockage in the pipe.

Turning now to FIG. 7, there is illustrated another embodiment of the cleanout device of the present invention. This form of the invention is in many respects similar to that shown in FIGS. 1 through 6 and like numerals are used to identify like parts. However, in addition to a first housing or casing 60 adapted to telescopically receive drive member 14 there is also provided a second casing 62 into which casing 60 may be telescoped. The use of the second casing 62 permits the use initially of longer length of snake having a length approximately equal to the combined length of the drive member 14, the first casing 60 and the second casing 62. For example, if the drive member and the first and second casings are each eighteen inches in length, the snake used would be approximately four and one-half feet in length. This type of tool provides a highly compact easy to use device embodying a substantial initial length of usable snake. Of course, like the earlier described embodiment of the invention, a coupling leader 18 is used so that any number of lengths of supplementary snakes can be attached to the leader giving the device the capability of reaching clogged sections many feet within the plumbing circuit.

Referring to FIG. 8, the slip joint between the first and second casings can be seen to include a resilient O-ring 64 receivable within an annular groove 66 formed near the outboard end of casing 60. Second casing 62, which is slightly larger in diameter than first casing 60, closely receives the O-ring and at its inboard end is provided with an inturned lip 68 adapted to prevent separation of the two casings.

The operation of the device of this embodiment is similar to that of the basic device as previously described save that as a final step after the drive tube has been inserted into the first casing, the entire assemblage is then telescoped into the second casing 62. It is this feature which permits the use of a longer initial length of snake.

In FIG. 9 there is shown yet another form of the cleanout tool of the invention. This embodiment is quite similar to the embodiment shown in FIGS. 8 and 9 and like numerals are used to identify like parts. However, in the device depicted in FIG. 9, a rigid drive rod 70 is substituted for the drive tube 14. This drive rod is connected at one end to the crank handle 16 and at its other end to the coupling leader 18 and functions to rotatably interconnect the crank handle and the coupling leader. With this arrangement the coupling leader and a portion of the initial length of snake is not telescopically receivable in the drive member. Accordingly, the initial length of the snake used has a length approximately equal to the combined length of the first and second casings.

The device of FIG. 9 operates in a similar manner to the embodiments previously described and may be manufactured more inexpensively. Due to the uniquely designed telescoping first and second casings, and their rigid drive rod feature, it provides a highly useful and versitile tool which for many applications functions in a superior manner.

In using any of the illustrated embodiments of the invention, by simply adding supplementary lengths of coiled spring a run of waste line of virtually infinite length can be conveniently cleaned. No prior art devices known to the present inventor offer this unique advantage. Prior to the instant invention when it was necessary to clean out long lengths of waste line, the use of large, complex equipment was required. Such equipment, of necessity, included bulky storage drums which housed long lengths of coiled spring and from which the spring was payed out into the line. Even with very large equipment, however, the drum size constituted a practical limitation on the length of waste line which could be cleaned. Due to the unique character of the device of the present invention, the device itself can remain compact and inexpensive and the necessity for large coil spring storage drums is uniquely obviated.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A waste pipe cleanout device comprising:

(a) a first elongated casing member;

(b) an elongated drive member telescopically receivable in said first casing member;

(c) interengaging means affixed to one end of said drive member for rotating said member;

(d) a coupling leader connected to the other end of said drive member and adapted to project a limited distance from said casing member when said drive member is fully telescopically received therewithin, said coupling leader being rotatable with said drive member and having first interlocking means at its free end for removably interlocking together therewith a length of flexible coiled spring; and (e) a length of flexible coiled spring having at one end thereof a second interlocking means adapted to mate with said first interlocking means whereby rotation of said drive member causes rotation of said coiled spring.

2. A device as defined in claim 1 in which said elongated drive member is hollow, being adapted to telescopically receive therewithin said coupling leader and a portion of said flexible coiled spring and having proximate each end thereof connecting means for removably interconnecting said coupling leader.

3. A device as defined in claim 1 in which said first interlocking means comprises a male member having a spring biased detent carried thereby and said second interlocking means comprises a female member adapted to mate with said male member and having a detent receiving aperture formed therein.

4. A device as defined in claim 1 including a second elongated casing member adapted to telescopically receive said first elongated casing member.

5. A device as defined in claim 4 in which said first and second elongated casing members and said drive member are substantially the same length.

6. A waste pipe cleanout device comprising:

(a) a first elongated casing member;

(b) an elongated drive member telescopically receivable in said first casing member;

(c) a second elongated casing member adapted to telescopically receive said first elongated casing member;

(d) a crank handle affixed to one end of said drive member for rotating said member;

(e) a coupling leader connected to the other end of said drive member and adapted to project a limited distance from said first casing member when said drive member is fully telescopically received therewithin, said coupling leader being rotatable with said drive member and having first interlocking means of its free end for removably interlocking together therewith a length of flexible coiled spring; and (f) a length of flexible coiled spring having at one end thereof a second interlocking means adapted to mate with said first interlocking means whereby rotation of said drive member causes rotation of said coiled spring, said coiled spring having a length substantially equal to the combined length of said first and second casing members.

7. A device as defined in claim 6 in which said elongated drive member is hollow, being adapted to telescopically receive therewithin said coupling leader and a portion of said flexible coiled spring and having proximate each end thereof connecting means for removably interconnecting said coupling leader.

8. A waste pipe cleanout device comprising:

(a) a first elongated casing member;

(b) an elongated drive member telescopically receivable in said first casing member, said drive member being hollow and having proximate each end thereof leader connecting means;

(c) a second elongated casing member adapted to telescopically receive said first elongated casing member;

(d) a crank handle affixed to said drive member for rotating said member;

(e) a coupling leader having at a first end connecting means adapted to mateable engage said leader connecting means whereby said coupling leader is rotatable with said drive member and having at its second end spring interlocking means for removably interlocking together therewith a length of flexible coiled spring; and (f) a length of flexible coiled spring having at one end thereof interlocking means adapted to mate with said spring interlocking means whereby rotation of said drive member causes rotation of said coiled spring, said coiled spring having a length substantially equal to the combined length of said first casing member, said second casing member and said hollow drive member.

9. A device as defined in claim 8 in which said connecting means of said coupling leader comprises a member having a spring biased detent carried thereby and said leader connecting means of said drive member comprises detent receiving apertures formed proximate the ends of said hollow drive member.

10. A device as defined in claim 9 in which said spring interlocking means of said coupling leader comprises a male member having a spring biased detent carried thereby and said interlocking means of said coiled spring comprises a female member adapted to mate with said male member and having a detent receiving aperture formed therein.

* * * * *